United States Patent [19]

Teegarden

[11] Patent Number: 4,462,771

[45] Date of Patent: Jul. 31, 1984

[54] WRAP ELEMENT AND TIP SEAL FOR USE IN FLUID APPARATUS OF THE SCROLL TYPE AND METHOD FOR MAKING SAME

[75] Inventor: Arlo F. Teegarden, Stoddard, Wis.

[73] Assignee: The Trane Company, La Crosse, Wis.

[21] Appl. No.: 232,527

[22] Filed: Feb. 9, 1981

[51] Int. Cl.[3] ..... F01C 1/02; F01C 19/08; B23P 15/06; F16J 9/04

[52] U.S. Cl. ..... 418/55; 418/142; 29/156.4 R; 277/204; 277/236

[58] Field of Search ..... 418/55, 142, 148; 277/81 P, 83, 84, 92, 96, 96.1, 204, 167, 216, 217, 236; 29/156.4 R, 456

[56] References Cited

U.S. PATENT DOCUMENTS

| | | | |
|---|---|---|---|
| 56,699 | 7/1866 | Cameron | 277/167 |
| 1,965,294 | 7/1934 | Marshall | 277/216 |
| 2,259,422 | 10/1941 | Karlberg | 277/92 |
| 3,059,584 | 10/1962 | Cottell | 418/142 |
| 3,235,273 | 2/1966 | Bialkowski | 277/96.1 |
| 3,476,397 | 11/1969 | Thoren et al. | 277/83 |
| 3,994,636 | 11/1976 | McCullogh et al. | 418/55 |
| 4,176,848 | 12/1979 | Lafuze | 277/92 |
| 4,199,308 | 4/1980 | McCullough | 418/55 |
| 4,290,497 | 9/1981 | Barnetche | 277/83 |

OTHER PUBLICATIONS

*The Gasket,* Goetze Gasket and Packing Co., Inc., New Brunswick, N.J., 1944.

*Primary Examiner*—John J. Vrablik
*Attorney, Agent, or Firm*—Carl M. Lewis; Peter D. Ferguson; Ronald M. Anderson

[57] ABSTRACT

A wrap element and tip seal are disclosed for use in fluid apparatus of the scroll type which include a wrap element having a groove disposed within its tip surface of spiroidal configuration generally conforming to that of the wrap element. A tip seal is disposed within the groove and comprises a relatively rigid strip of material having been wound about its longitudinal axis into a spiroidal configuration generally conforming to that of the groove, the strip of material having a cross section taken in a plane substantially perpendicular to its longitudinal axis wherein at least the radially outer surface thereof is convex in a radially outward direction. This configuration for the tip seal has the advantage that it may be formed using conventional winding techniques wherein a certain amount of "twist" about the longitudinal axis of the strip of material is normally encountered.

22 Claims, 15 Drawing Figures

WRAP ELEMENT AND TIP SEAL FOR USE IN FLUID APPARATUS OF THE SCROLL TYPE AND METHOD FOR MAKING SAME

DESCRIPTION

1. Technical Field

The present invention relates generally to the field of fluid apparatus of the scroll type, including compressors, pumps, and expanders; and is specifically directed to an improvement in such apparatus relating to the tip seal provided therein which effects sealing between the axial tip portion of a wrap element and a cooperating end plate.

2. Background Art

In the field of positive displacement fluid apparatus, there exists a class or category generally referred to as scroll-type fluid apparatus which are characterized by the provision of wrap elements defining flank surfaces of generally spiroidal configuration about respective axes, which wrap elements lie in intermeshing, angularly offset relationship with their axes generally parallel such that relative orbital motion between the wrap elements results in the formation of one or more moving volumes between the wrap elements, defined by moving lines of coaction between the wrap elements at which their flank surfaces lie substantially tangent to each other. In a preferred form, the precise shape of the generally spiroidal flank surfaces comprise an involute of a circle, however, the term "generally spiroidal" is intended to encompass any form providing the requisite moving volumes during relative orbital motion between the wrap elements. Typically, end plate means are provided in sealing relationship to the wrap elements as they undergo relative orbital motion such that the moving volumes are effectively sealed. Reference may be had to U.S. Pat. No. 801,182 for an early disclosure of scroll-type fluid apparatus embodying this principle, or to U.S. Pat. No. 3,884,599 for a more recent disclosure.

It has been recognized that scroll-type fluid apparatus have utility in a wide variety of applications, including gas compressors or vacuum pumps for elevating the pressure of a gaseous working fluid; liquid pumps for transporting a liquid working fluid; or as an expansion engine for producing mechanical work by the expansion of a relatively high pressure gaseous working fluid. In the case of a gas compressor, the moving volumes defined between wrap elements originate at a radially outer portion thereof and progress inwardly while their volume is reduced, resulting in compression of the working gas which is then discharged at a radially inner portion of the wrap elements. Liquid pumps function in a similar fashion with the wrap elements configured such that no appreciable reduction in volume occurs as the volumes progress radially inwardly, while scroll-type expansion engines receive a relatively high pressure gaseous working fluid at the radially inner portion of their wrap elements, which then progresses radially outwardly in the moving volumes as they increase in volume, resulting in expansion of the working fluid and production of mechanical work.

In considering the kinematic relationship necessary in order to effect the requisite relative orbital motion between the wrap elements, it should be noted that at least three general approaches exist:

(1) maintaining one wrap element fixed while orbiting the other with respect thereto, i.e., causing it to undergo circular translation while maintaining a fixed angular relationship between the wrap elements;

(2) orbiting both wrap elements in opposite directions while maintaining a fixed angular relationship therebetween; and (3) rotating both wrap elements about offset, parallel axes while maintaining a fixed angular relationship therebetween.

A second consideration relevant to the relative orbital motion between wrap elements is the manner in which their flank surfaces are permitted to coact with each other; i.e., is actual contact permitted therebetween along the lines at which the surfaces lie substantially tangent, accompanied by a radial sealing force therebetween; or are constraints imposed thereon so as to maintain a slight clearance or gap therebetween. In this regard, it is convenient to term the former as "radially compliant" type, while the latter may be referred to as "fixed-crank" type. As used herein, the term "moving line coaction" is intended to be descriptive of both types, while the term "actual moving line contact" is limited to the radially compliant type. Reference may be had to U.S. Pat. No. 3,924,977 for disclosure of a radially compliant type drive mechanism, while U.S. Pat. No. 4,082,484 is illustrative of the fixed-crank type Reference may be had to the aforementioned U.S. Pat. No. 801,182 for an early disclosure of a tip seal for use in scroll apparatus, while U.S. Pat. No. 3,994,636 is illustrative of a more recent development in this area. In both these references, however, it is apparent that the seal elements disclosed therein are constructed from strips of material having square or rectangular cross sections such that a relatively flat involute surface of the seal element is required to cooperate with a relatively flat surface of the groove formed in the wrap element. This requirement has been found to be a drawback in that very accurate machining or forming of the strip of material is required in order to insure proper mating of the two surfaces. Moreover, in the case where it is desired to form the tip seal from a strip of material using forming techniques such as winding, it has been found that the strip of material is susceptible to "twist" about its longitudinal axis during the winding process, resulting in a tip seal unsuitable for use without further expensive machining operations of the involute surface or surfaces.

DISCLOSURE OF THE INVENTION

In accordance with the present invention, a wrap element and tip seal are provided wherein the wrap element defines first and second flank surface of generally spiroidal configuration about a reference axis, the flank surfaces extending generally in an axial direction and terminating in a tip surface lying in a plane substantially perpendicular to the axis. A groove is disposed within the tip surface also having a spiroidal configuration generally conforming to that of the flank surfaces, the groove including at least a radially outer lateral wall and a bottom wall. Disposed at least partially within the groove is a tip seal comprising a relatively rigid strip of material having been wound about its longitudinal axis into spiroidal configuration generally conforming to that of the groove, the strip of material having a cross section taken in a plane substantially perpendicular to its longitudinal axis wherein at least the radially outer surface thereof is convex in a radially outward direction.

The groove itself may include only a radially outer lateral wall and a bottom wall or, in the alternative, may include both radially inner and outer lateral walls as well as a bottom wall. Other variations in the configuration of the groove include the provision of a radially outer lateral wall which is inclined radially outwardly in a direction toward the tip surface.

The configuration of the aforementioned cross section of the strip of material comprising the seal element may be circular, so as to define a radially outer surface convex in a radially outward direction as well as a radially inner surface, convex in a radially inward direction. Alternatively, the cross section of the strip of material may include a generally flat sealing surface lying in a plane substantially perpendicular to the aforementioned reference axis and/or a generally flat base surface also lying in a plane substantially perpendicular to the reference axis. In the preferred embodiment, the tip seal is constructed from a strip of material comprising steel.

Further, in accordance with the invention, a variety of back-up means may be provided for imposing a force upon the strip of material in an axial direction away from the wrap element while permitting movement thereof in an axial direction.

In accordance with another aspect of the invention, a method of making the tip seal comprises winding a strip of relatively rigid material into generally spiroidal configuration about a reference axis, which strip of material has a cross section taken in a plane substantially perpendicular to its longitudinal axis wherein at least the radially outer surface thereof is convex in a radially outward direction.

Accordingly, it is a primary object of the present invention to provide a tip seal and method for making same wherein the tip seal comprises a strip of relatively rigid material having been wound into a generally spiroidal configuration so as to cooperate with a groove formed in a wrap element, without the need for expensive machining of the radially outer and/or inner surfaces of the tip seal.

A further object of the invention is to provide a tip seal for use in fluid apparatus of the scroll type which can be formed from conventionally available material stocks, using known winding techniques, without resorting to expensive machining operations.

Yet another object of the invention is the provision of a tip seal which effects a good secondary seal with a radially outer lateral wall of the groove, while also providing good axial sealing.

These and further objects of the invention will become apparent from a consideration of the detailed description of the invention which follows and by reference to the accompanying drawings.

BRIEF DESCRIPTION OF THE DRAWINGS

FIGS. 3(*b*) through 3 (*l*) are cross section views taken along the line 3—3 of FIG. 1, illustrating a variety of configurations which the tip seal and back-up means may take in accordance with the present invention.

BEST MODE FOR CARRYING OUT THE INVENTION

Figure 1:
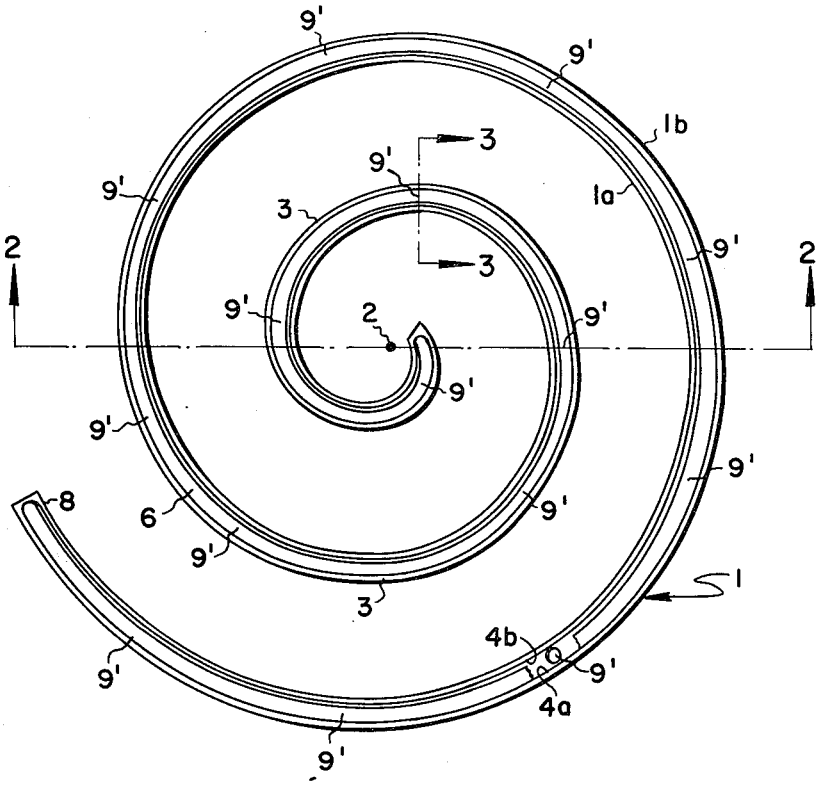
FIG. 1 is a plan view of a wrap element for use in fluid apparatus of the scroll type, including a tip seal constructed in accordance with the present invention.

Turning first to FIG. 1 of the drawings, a wrap element for use in fluid apparatus of the scroll type is illustrated in plan view, designated generally by reference numeral 1. Wrap element 1 includes a first, radially inner flank surface 1*a* and a second, radially outer flank surface 1*b* which, as is apparent from FIG. 1, are of generally spiroidal configuration about an axis or reference axis 2. From FIG. 2, it can be seen that the flank surfaces 1*a* and 1*b* extend in an axial direction and terminate in a tip surface 3 lying in a plane substantially perpendicular to axis 2.

Disposed within tip surface 3 is a groove having a radially outer lateral wall 4*a*, a radially inner lateral wall 4*b*, and a bottom wall 4*c*. As is apparent from FIG. 1 the groove is of spiroidal configuration generally conforming to that of flank surfaces 1*a* and 1*b*, and has a width measured in a generally radial direction with respect to axis 2 and a depth measured in an axial direction from tip surface 3.

Figure 2:
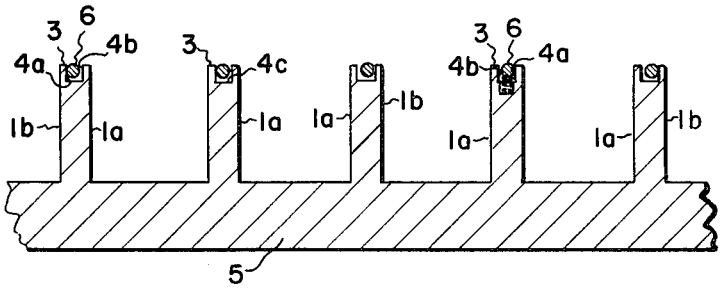
FIG. 2 is a cross section taken along the line 2—2 of FIG. 1.
Figure 3A:
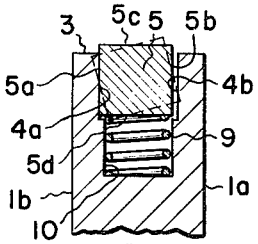
FIG. 3(a) (PRIOR ART)
FIG. 3(*a*) is a cross section taken along the line 3—3 of FIG. 1, illustrating a prior art tip seal.
Figure 3B:
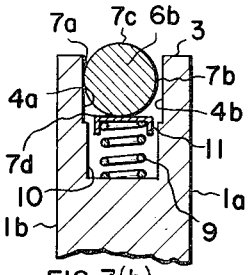
Figure 3C:
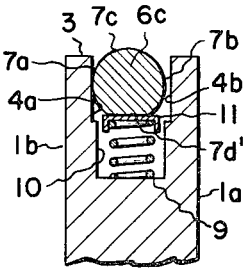
Figure 3D:
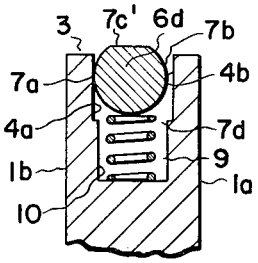
Figure 3E:
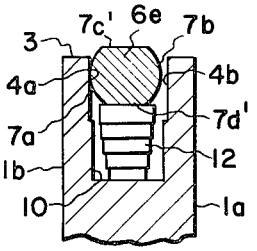
Figure 3F:
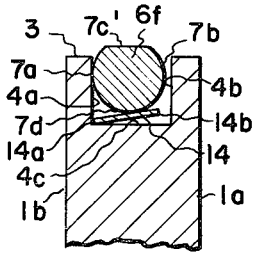
Figure 3G:
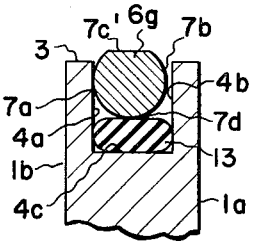
Figure 3H:
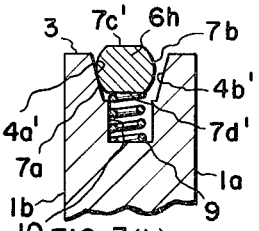
Figure 3I:
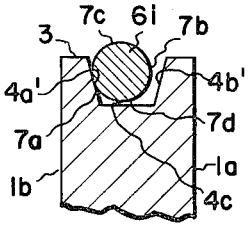
Figure 3J:
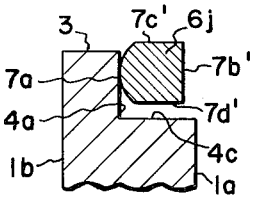
Figure 3K:
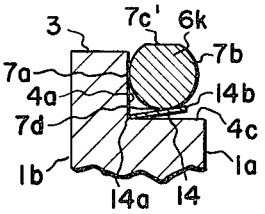
Figure 3L:
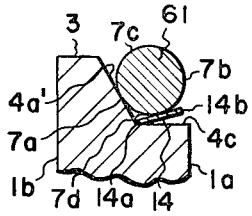

Before proceeding to a detailed discussion of the novel tip seal comprising the present invention, it should be pointed out that wrap elements of the type illustrated in FIGS. 1 and 2 are well known to those skilled in the art of fluid apparatus of the scroll type, as discussed previously in the subject application. As further illustrated in FIG. 2, the wrap element may be affixed to an end plate 5 such that fluid apparatus of the scroll type may be constructed utilizing two, substantially identical scroll members arranged in intermeshing, angularly offset relationship as described in many of the references alluded to previously.

Before proceeding to a discussion of the novel tip seal comprising the present invention, attention should be directed to FIG. 3(*a*) of the drawings which comprises a cross section view of the prior art tip seal and illustrates a problem associated therewith which is solved by the present invention. As shown in FIG. 3(*a*), it has been previously suggested in the field of scroll type fluid apparatus that a tip seal be provided therefor having a square or rectangular cross section and which fits within the groove of the wrap element so as to provide a close, sliding fit. While seals of this type have proven satisfactory in operation, they suffer from the drawback of being relatively expensive to manufacture in that the radially outer lateral wall 5*a* and radially inner lateral wall 5*b* must be machined to relatively close tolerances in order to fit accurately within the groove machined within the tip of the wrap element. While it would appear that the tip seal illustrated in FIG. 3(*a*) could be formed through a winding operation using a strip of material having the illustrated square or rectangular cross section, this technique has proved to be unworkable due to "twist" along the longitudinal axis of the strip of material as it undergoes the winding operation. This problem is illustrated in FIG. 3(*a*) wherein the tip seal 5 is illustrated in a dotted line position brought about due to the aforementioned "twist" of the strip of material. Obviously, such a tip seal would be unworkable without further machining operations due to the interference which would be presented with the lateral walls 4*a* and 4*b* of the groove.

Applicant has addressed the problem described immediately above and the solution thereto is illustrated in FIGS. 3(*b*) through 3(*l*) of the drawings. Turning first to FIG. 3(*b*), it can be seen that applicant has provided a tip seal comprising a relatively rigid strip of material 6b which has been wound about its longitudinal axis into spiroidal configuration generally conforming to that of the groove. Specifically, strip 6b is shown to have a cross section taken in a plane substantially perpendicular to its longitudinal axis wherein at least the radially outer surface 7a thereof is convex in a radially outward direction. More particularly, strip 6b is shown to have a substantially circular cross section as defined by a radially inner surface 7b convex in a radially inward direction, as well as a sealing surface 7c and base surface 7d of convex configuration.

The use of a strip of material 6b having at least a radially outer surface which is convex in a radially outward direction has a distinct advantage over the arrangement illustrated in FIG. 3(*a*) since, even if strip 6b is twisted slightly about its longitudinal axis during the winding operation, surface 7a will simply be rotated slightly and continue to have a continuous line at which it remains tangent to radially outer lateral wall 4a. Thus, no relatively expensive machining operation is necessary in order to conform surface 7a to the involute configuration of surface 4a as would be required in the case illustrated in FIG. 3(*a*).

As illustrated in FIG. 3(*b*), tip seal 6b occupies a position within the groove such that surface 7a thereof is in actual sealing contact with lateral wall 4a. This is the position which the seal would occupy during operation of fluid apparatus of the scroll type wherein a higher fluid pressure exists adjacent the inner flank surface 1a than at radially outer flank surface 1b; the pressure differential urging tip seal 6b to the position indicated. It is thus apparent that a good secondary seal must be provided between surfaces 7a and 4a, which is accomplished by the present invention due to the convex configuration of surface 7a, providing good sealing contact irrespective of twist occurring in the tip seal during winding thereof. As will be appreciated by those skilled in the art, surface 7c of tip seal 6b provides axial sealing by contact with the end plate of a mating scroll member.

Continuing with reference to FIG. 3(*b*), it can be seen that tip seal 6b is urged in an axial direction by back-up means comprising a coil spring 9 having a cap member 11 mounted on an end thereof. From FIG. 1, it can be seen that a plurality of coil springs 9 are provided, each disposed within a bore 10 in the bottom wall of the groove, and spaced along the longitudinal axis of the tip seal at locations designed 9'. The back-up means serve not only to urge tip seal 6b into contact with the aforementioned mating scroll member, but also permit a certain degree of movement of the tip seal in an axial direction so as to afford axial compliance within the fluid apparatus.

Turning next to FIG. 3(*c*) of the drawings, a slight modification of that shown in FIG. 3(*b*) is illustrated wherein the base surface 7d' of tip seal 6c is flattened in order to provide a broader seating surface for cap member 11. Surface 7d' may be formed prior to the winding of tip seal 6c, or afterward through a relatively simple grinding operation. In either event, it will be appreciated that the benefits associated with the convex configuration of surfaces 7a and 7b discussed previously will be realized.

FIG. 3(*d*) of the drawings illustrates another modification in accordance with the present invention wherein tip seal 6d includes a flattened sealing surface 7c' for coaction with the flat end plate of the mating scroll member discussed above. Surface 7c' also may be formed either prior to the winding of tip seal 6d, or thereafter as by a grinding operation. Once again the benefits of convex surfaces 7a and 7b are realized. The embodiment of FIG. 3(*d*) differs further over that of FIGS. 3(*b*) and 3(*c*) in that no cap member 11 is provided between coil spring 9 and surface 7d, of the tip seal.

Turning now to FIG. 3(*e*), yet a further embodiment of the invention is illustrated wherein tip seal 6a is provided with both a flattened base surface 7d' and a flattened sealing surface 7c', as discussed previously. As before, these flattened surfaces may be formed either prior to or after the seal element is wound into its spiroidal configuration. This embodiment is further distinguished through the use of a coil spring 12 of the volute type as the back-up means.

FIG. 3(*f*) of the drawings illustrates an embodiment wherein the tip seal 6f is substantially identical to that illustrated in FIG. 3(*d*), but wherein the back-up means employed differ substantially from those of the previous embodiments. Particularly, the back-up means illustrated in FIG. 3(*f*) comprise an elongated spring member 14 disposed between bottom wall 4c of the groove and surface 7d of seal element 6f. Spring member 14 extends along a longitudinal axis about the spiroidal configuration of groove 4 and has a position therein such that its radially outer edge portion 14a engages the bottom wall 4c of the groove while its radially inner edge portion 14b is axially spaced therefrom. With this configuration, spring member 14 acts according to the principle of the Belleville spring or washer such that an axial force is developed as edge portion 14b is displaced toward bottom wall 4c of the groove, thereby providing the axial force previously discussed while permitting limited axial movement of tip seal 6f. Reference may be had to copending, commonly assigned application Ser. No. 06/232,528 filed Feb. 9, 1982, for a complete disclosure of this type back-up member, which disclosure is hereby incorporated herein.

FIG. 3(*g*) of the drawings illustrates a further embodiment of the invention, similar to that of FIG. 3(*f*), with the exception that the back-up means comprise a length of resilient cord stock 13 disposed within the groove between its bottom wall 4c and the underside of tip seal 6g. This type back-up means is disclosed in previously referenced U.S. Pat. No. 3,994,636 and, as discussed therein, has the advantage of providing a positive secondary seal in order to prevent leakage underneath the seal element.

The embodiment of the invention illustrated in FIG. 3(*h*), while incorporating a tip seal generally similar to that discussed with respect to FIG. 3(*e*), differs in that the lateral walls of groove 4 are inclined as shown; radially outer lateral wall 4a' being inclined radially outwardly in a direction toward tip surface 3, and radially inner lateral wall 4b' being inclined radially inwardly in a direction toward tip surface 3. This configuration has the advantage that, as tip seal 6h is urged in a radially outward direction due to the previously discussed pressure forces acting thereon, a component of the resultant force acting between surface 4a' and surface 7a urges tip seal 6h in an axial direction so as to increase the sealing force between it and the end plate of a cooperating scroll member.

FIG. 3(*i*) illustrates an embodiment of the invention wherein the groove 4 is generally similar to that of FIG. 3(*h*), but wherein no back-up means are employed for imposing an axial force upon tip seal 6*i*. In this embodiment, only the pressure forces acting thereon are relied upon in order to urge the tip seal 6*i* into sealing engagement with radially outer lateral surface 4*a'* and with the end plate of a cooperating scroll member. Reference may be had to U.S. Pat. No. 3,994,636 (FIG. 3) for disclosure of a tip seal wherein no back-up means are employed.

FIG. 3(*j*) of the drawings illustrates an embodiment wherein the groove disposed within wrap element 1 includes only a radially outer lateral wall 4*a* and a bottom wall 4*c*, an arrangement disclosed in U.S. Pat. No. 4,199,308. In this embodiment, tip seal 6*j* retains the configuration described with respect to the preceding embodiments wherein its radially outer surface 7*a* is convex in a radially outward direction in order to achieve the previously discussed advantages associated therewith. This embodiment is similar to that of FIG. 3(*i*) to the extent that no back-up means are provided and only the pressure forces acting on tip seal 6*j* are utilized in order to urge it into a sealing position.

The embodiment of FIG. 3(*k*) also includes a groove having only a radially outer lateral wall 4*a* and a bottom wall 4*c*, and wherein tip seal 6*k* is generally similar to that illustrated with respect to FIGS. 3(*d*), (*f*), and (*g*). In this embodiment, back-up means in the form of an elongated spring member 14 as described with respect to FIG. 4(*f*) are utilized.

Finally, the embodiment of FIG. 3(*l*) incorporates a groove having only a radially outer lateral wall 4*a'* and a bottom wall 4*c*, but wherein wall 4*a'* is inclined radially outwardly in a direction toward tip surface 3 as discussed with respect to FIG. 3(*h*) and 3(*i*). As in the embodiment of FIG. 3(*k*), an elongated spring member 14 is utilized as a back-up means.

It should now be apparent from the foregoing description of FIGS. 3(*b*) through 3(*l*) of the drawings that the present invention resides in the provision of a tip seal having a cross section taken in a plane substantially perpendicular to its longitudinal axis wherein at least the radially outer surface thereof is convex in a radially outward direction, thereby avoiding the problem of twist during the winding thereof. As illustrated, the precise cross-section may take a number of forms, depending upon the configuration of the groove 4 into which the tip seal must be inserted. For example, in the embodiments of FIGS. 3(*b*) through 3(*g*) wherein radially outer and inner lateral walls 4*a* and 4*b* are provided, it is preferable that both the radially outer and inner surfaces 7*a* and 7*b* of the tip seal have the illustrated convex configuration. Moreover, depending upon the sealing characteristics of the material of which the tip seal is constructed, and the particular back-up means utilized, it may be desirable to provide flattened sealing surfaces 7*c'* or flattened base surfaces 7*d'* on the tip seal.

It is contemplated that the tip seal may be constructed from a variety of relatively rigid strips of material including not only metals such as steel or hardened steel, but also plastic-type materials which are relatively rigid and capable of being wound into the requisite spiroidal configuration and maintaining that configuration after being wound.

Figure 4:
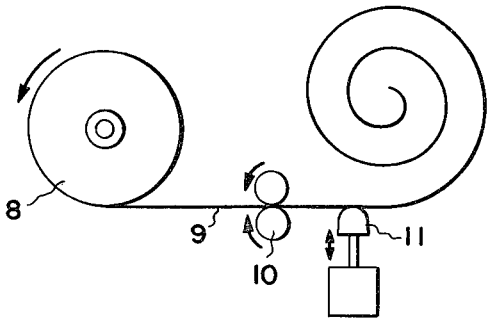
FIG. 4 is a simplified schematic drawing illustrating generally winding apparatus of the type which may be used in fabricating a tip seal according to the method of the present invention.

Turning next to FIG. 4 of the drawings, a simplified schematic diagram is provided to illustrate generally a method of making a tip seal in accordance with the present invention. Typically, the material of which the tip seal is constructed would be provided in strip form coiled on a spool or reel 8 mounted for rotation about a central axis. The strip of material 9 is lead therefrom through a set of rollers 10, following which it is engaged by a cam member 11 movable in the directions illustrated by the arrows thereby. As material 9 is engaged by cam member 11, it is bent in an upward direction (as viewed in FIG. 4) so as to be wound into the required spiroidal configuration. As will be appreciated, cam member 11 is initially at a relatively high level with respect to strip of material 9 so as to wind the relatively small radius inner wraps of the tip seal, and it is gradually lowered during the winding operation so as to form the relatively larger radius outer wraps thereof. As previously discussed, even though strip of material 9 may be subject to a degree of twist about its longitudinal axis during this operation, the resulting tip seal will nonetheless be suitable for use in the intended application as illustrated in FIG. 3 of the drawings. As also previously discussed, strip of material 9 may be of circular cross section initially, to be further machined subsequent to the winding operation; or may initially be formed to, say, the configuration of FIG. 3(*e*) prior to the winding operation.

With the invention has been described with respect to a number of specific embodiments, it is to be understood that variations thereto will become apparent to those skilled in the art upon a consideration thereof. Accordingly, the scope of the invention is to be determined in accordance with the scope and spirit of the claims which follow.

I claim:

1. A tip seal for use in fluid apparatus of the scroll type comprising a relatively rigid strip of material having been wound about its longitudinal axis into a generally spiroidal configuration about a reference axis and having a cross section taken in a plane substantially perpendicular to its longitudinal axis wherein at least the radially outer surface thereof in convex in a radially outward direction, constructed in accordance with the method comprising winding said strip of relatively rigid material into said generally spiroidal configuration about a reference axis in an operation in which the strip of material is subject to a degree of twist about its longitudinal axis.

2. The tip seal of claim 1 wherein said cross section of said strip of material further includes a radially inner surface which is convex in a radially inward direction.

3. The wrap element and tip seal of claim 1 wherein said strip of material comprises steel.

4. The tip seal of claim 1 or 2 wherein said cross-section of said strip of material is substantially circular.

5. The tip seal of claims 1 or 2 wherein said cross section of said strip of material includes a generally flat sealing surface lying in a plane substantially perpendicular to said reference axis.

6. The tip seal of claims 1 or 2 wherein said cross section of said strip of material includes a generally flat base surface lying in a plane substantially perpendicular to said reference axis.

7. The tip seal of claims 1 or 2 wherein said cross section of said strip of material includes a generally flat sealing surface lying in a plane substantially perpendicular to said reference axis, and a generally flat base surface also lying in a plane substantially perpendicular to said reference axis.

8. A wrap element and tip seal for use in fluid apparatus of the scroll type comprising a. a wrap element defining at least a first flank surface of generally spiroidal configuration about a reference axis, said flank surface extending generally in an axial direction and terminating in a tip surface lying in a plane substantially perpendicular to said reference axis;

b. a groove disposed within said tip surface of spiroidal configuration generally conforming to that of said flank surface, said groove including at least a radially outer lateral wall and having a width measured therefrom in a generally radial direction with respect to said axis and a depth measured in an axial direction from said tip surface; and c. a tip seal disposed at least partially within said groove comprising a relatively rigid strip of material having been wound about its longitudinal axis into a spiroidal configuration generally conforming to that of said groove and having a cross section taken in a plane substantially perpendicular to its longitudinal axis wherein at least the radially outer surface thereof is convex in a radially outward direction, constructed in accordance with the method comprising winding said strip of relatively rigid material into said generally spiroidal configuration about a reference axis in an operation in which the strip of material is subject to a degree of twist about its longitudinal axis.

9. The wrap element and tip seal of claim 8 wherein said wrap element defines first and second flank surfaces of generally spiroidal configuration, each of which extends in an axial direction and terminates in said tip surface lying in a plane substantially perpendicular to said reference axis.

10. The wrap element and tip seal of claim 8 further comprising back-up means for imposing a force upon said strip of material in an axial direction away from said wrap element while permitting movement thereof in an axial direction.

11. The wrap element and tip seal of claim 8 wherein said strip of material comprises steel.

12. The wrap element and tip seal of claim 8 wherein said groove includes only a radially outer lateral wall and a bottom wall.

13. The wrap element and tip seal of claim 12 wherein the radially outer lateral wall of said groove is inclined radially outwardly in a direction toward said tip surface.

14. The wrap element and tip seal of claim 8 wherein said groove further includes a radially inner lateral wall, and wherein said cross section of said strip of material further includes a radially inner surface which is convex in a radially inward direction.

15. The wrap element and tip seal of claim 14 wherein the radially outer lateral wall of said groove is inclined radially outward toward said tip surface.

16. The wrap element and tip seal of claim 8, 9, 10, 11, 12, 13, 14, or 15 wherein said cross section of said strip of material is substantially circular.

17. The wrap, element and tip seal of claim 8, 9, 10, 11, 12, 13, 14, or 15 wherein said cross section of said strip of material includes a generally flat sealing surface lying in a plane substantially perpendicular to said reference axis, said sealing surface lying proximate the tip surface of said wrap element.

18. The wrap element and tip seal of claim 8, 9, 10, 11, 12, 13, 14, or 15 wherein said cross section of said strip of material includes a generally flat base surface lying in a plane substantially perpendicular to said reference axis, said base surface lying in a lower portion of said groove.

19. The wrap element and tip seal of claim 8, 9, 10, 11, 12, 13, 14, or 15 wherein said cross section of said strip of material includes a generally flat sealing surface lying in a plane substantially perpendicular to said reference axis, and a generally flat base surface also lying in a plane substantially perpendicular to said reference axis; said sealing surface lying proximate the tip surface of said wrap element, and said base surface lying in a lower portion of said groove.

20. A method of making a tip seal for use in fluid apparatus of the scroll type comprising winding a strip of relatively rigid material into generally spiroidal configuration about a reference axis in an operation in which the strip of material is subject to a degree of twist about its longitudinal axis, said strip of material having a cross section taken in a plane substantially perpendicular to its longitudinal axis wherein at least the radially outer surface thereof is convex in a radially outward direction.

21. The method of claim 20 wherein said strip of material comprises steel.

22. The method of claims 20 or 21 wherein said cross section of said strip of material is circular.

* * * * *